US006032601A

United States Patent [19]

Gates

[11] Patent Number: 6,032,601

[45] Date of Patent: Mar. 7, 2000

[54] COMBINATION BOAT LIFT AND DOCK

[76] Inventor: Craig D. Gates, 13618 N. Stone La., Spokane, Wash. 99208

[21] Appl. No.: 09/263,468

[22] Filed: Mar. 5, 1999

[51] Int. Cl.[7] ..... B63C 1/02

[52] U.S. Cl. ..... 114/45; 405/3

[58] Field of Search ..... 405/1, 3, 678; 114/45–48

[56] References Cited

U.S. PATENT DOCUMENTS

| | | | |
|---|---|---|---|
| 17,892 | 7/1857 | Pouton . | |
| 907,952 | 12/1908 | Bartlett . | |
| 1,264,257 | 4/1918 | Beckwith . | |
| 2,938,352 | 5/1960 | Knapp et al. . | |
| 3,065,721 | 11/1962 | Roudabush | 114/5 |
| 3,114,535 | 12/1963 | Burch | 254/127 |
| 3,265,024 | 8/1966 | Kramlich | 114/45 |
| 3,270,698 | 9/1966 | Fort . | |
| 3,276,211 | 10/1966 | Drake . | |
| 3,415,212 | 12/1968 | Hennig | 114/45 |
| 3,448,712 | 6/1969 | Lehmann et al. . | |
| 3,603,276 | 9/1971 | De Lisle | 114/45 |
| 3,610,192 | 10/1971 | Mauritzen | 114/45 |
| 3,638,437 | 2/1972 | Fukuda | 61/64 |
| 3,857,248 | 12/1974 | Rutter | 61/65 |
| 3,895,592 | 7/1975 | King | 114/45 |
| 4,018,179 | 4/1977 | Rutter | 114/45 |
| 4,072,119 | 2/1978 | Williams | 114/45 |
| 4,287,625 | 9/1981 | Dawson | 9/1.6 |
| 4,381,723 | 5/1983 | Furst | 114/45 |
| 4,391,550 | 7/1983 | Rutter | 405/7 |
| 4,750,444 | 6/1988 | Lemvig | 114/45 |
| 5,090,841 | 2/1992 | Penick, Jr. et al. | 405/3 |
| 5,099,778 | 3/1992 | Palen | 114/45 |
| 5,131,342 | 7/1992 | Sackett | 114/48 |
| 5,140,922 | 8/1992 | Bowman et al. | 114/45 |
| 5,826,528 | 10/1998 | Jancsek | 114/45 |
| 5,860,379 | 1/1999 | Moody | 114/45 |

*Primary Examiner*—Stephen Avila
*Attorney, Agent, or Firm*—Wells, St. John, Roberts, Gregory & Matkin, P.S.

[57] ABSTRACT

A preferred embodiment of a combination boat lift and dock 10 is described having two spaced pontoons with an intermediate boat support 18. Pivot arm structures 20, 22 pivotally interconnect the boat support 18 with the pontoons. A drive mechanism 24 is connected to the pivot arm structures 20, 22 for pivoting the arm structures downward and inward to move at least one of the pontoons laterally inward toward the other pontoon to raise the boat support to lift a stored boat out of the water. The drive mechanism 24 is also designed to pivot the arm structures upward and outward to move at least one of the pontoons away form the other pontoon to lower the boat support 18 and lowering the boat into the water. The arm structures are pivotally connected to the underside of the pontoons. The dock 10 further includes a pontoon stabilizing mechanism 26 for preventing the pontoons from rocking or tilting.

10 Claims, 7 Drawing Sheets

COMBINATION BOAT LIFT AND DOCK

TECHNICAL FIELD

This invention relates to boat docks with features for lifting stored boats into and out of the water.

BACKGROUND OF THE INVENTION

For many years there has been a need for an inexpensive boat dock having the capability of easily lifting and lowering a stored boat into and out of the water to minimize the attachment of dirt, slime and organic material onto the bottom of the boat. Such a need is particularly important to vast numbers of recreational boat owners that use the many lakes, rivers and seas for recreational purposes such as sightseeing, recreational fishing and water sports such as water skiing. Many recreational boat owners have rather small motorized boats with lengths less than 36 feet. Most often, the boats are moored at personal docks or at small marinas. Most often, the boats are used on weekends or while the owners are on vacation. It is quite common for the boats to sit idle at the docks for several days or weeks between use. Thus it is not unusual for the bottoms of the boats to accumulate dirt, slime and organic material while sitting idle.

The problem is made even more difficult for boat owners that use waterways that have water surface levels that frequently vary along the shoreline. Many of the presently used boat lift mechanisms used for small boats require that they be supported on the bottom of the waterway near the shoreline. Not only are they rather expensive, but they are frequently unusable should the water level materially vary. This is particularly a major problem for waterways that have substantial tides. Consequently many boat owners buoy moor their boats away from the shoreline without the benefit of a dock or any way of lifting the boats above the waterline to prevent buildup of undesirable material on the bottom of their boats when they are not in use.

Furthermore, most personal boat docks are rather unprotected from heavy winds and storms which may occur while the boat owners are not present. It is not unusual for the winds and storms to create large waves that may cause the boats to oscillate up and down ripping the hold-downs from the docks and causing the sides of the boats to slam into the sides of the docks causing considerable damage to the boats and docks. Even though substantial damage may occur, it is difficult for a recreational boat owner to justify buying an expensive boat lift system. Most boat lift systems are rather expensive and are only justified for permanent boat storage during the "off season" at a professional boat storage facility.

One of the principal objectives of this invention is to provide a combination boat lift and dock that is relatively inexpensive for storing and mooring a boat, particularly a rather small boat, and for raising and lowering the boat into and out of the water with considerable ease.

An additional objective of this invention is to provide a rather inexpensive combination boat lift and dock that does not require support from the bottom of the waterway or against a rather rigid piling.

A further objective of this invention is to provide a rather inexpensive combination boat lift and dock that is rather easy to transport and assemble and placed at a desired location without special equipment and extensive training or skills.

These and other objects and advantages of this invention will become apparent upon reviewing the following drawings and written specification of a preferred embodiment of this invention.

BRIEF DESCRIPTION OF THE DRAWINGS

Preferred embodiments of the invention are described below with reference to the following accompanying drawings.

FIG. 5 is a view similar to FIG. 4 except showing the stabilization mechanism maintaining the pontoons horizontally stable when the combination boat lift and dock is in the elevated position;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
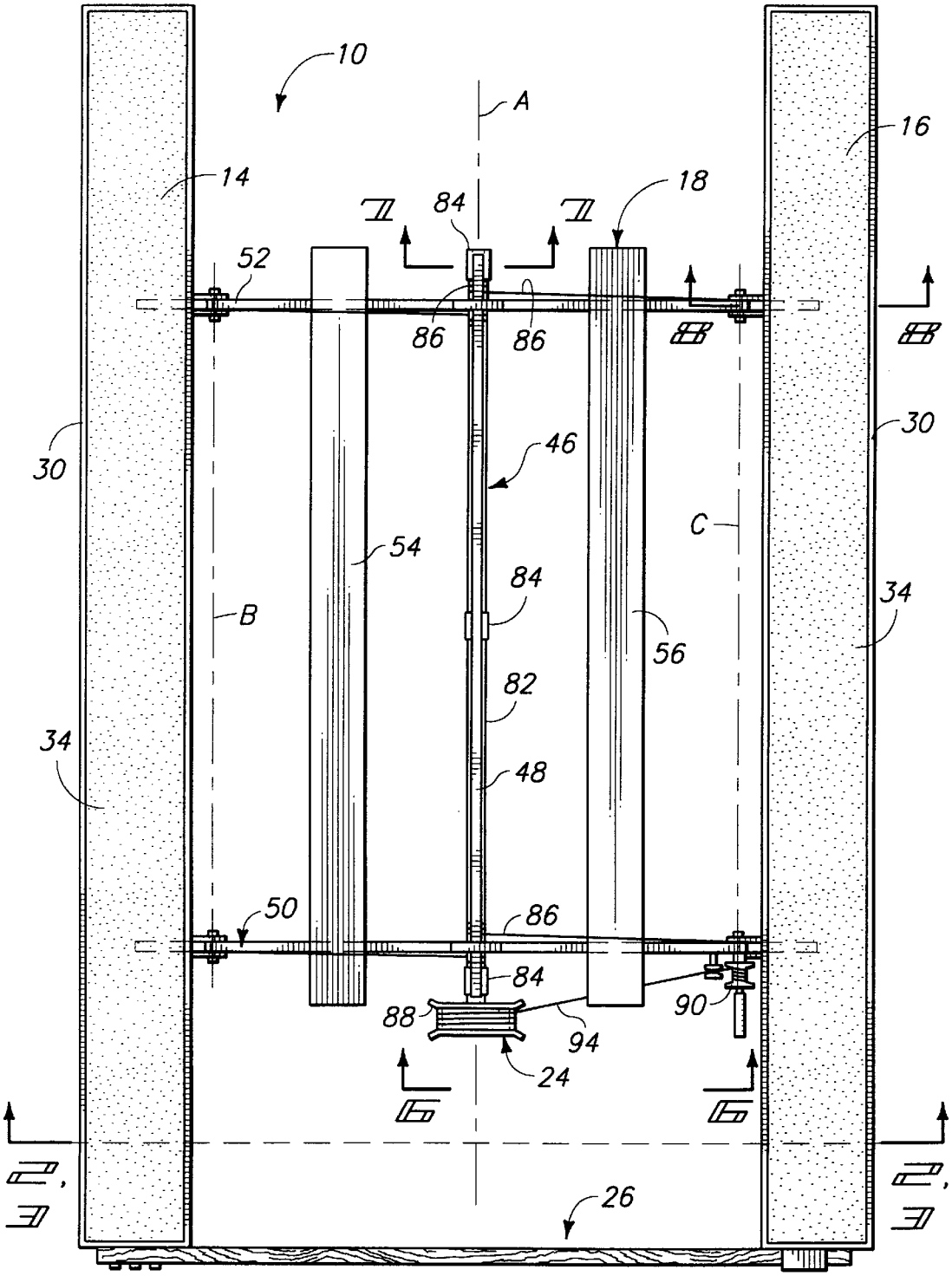
FIG. 1 is a plan view of a preferred embodiment of the combination boat lift and dock invention.
Figure 2:
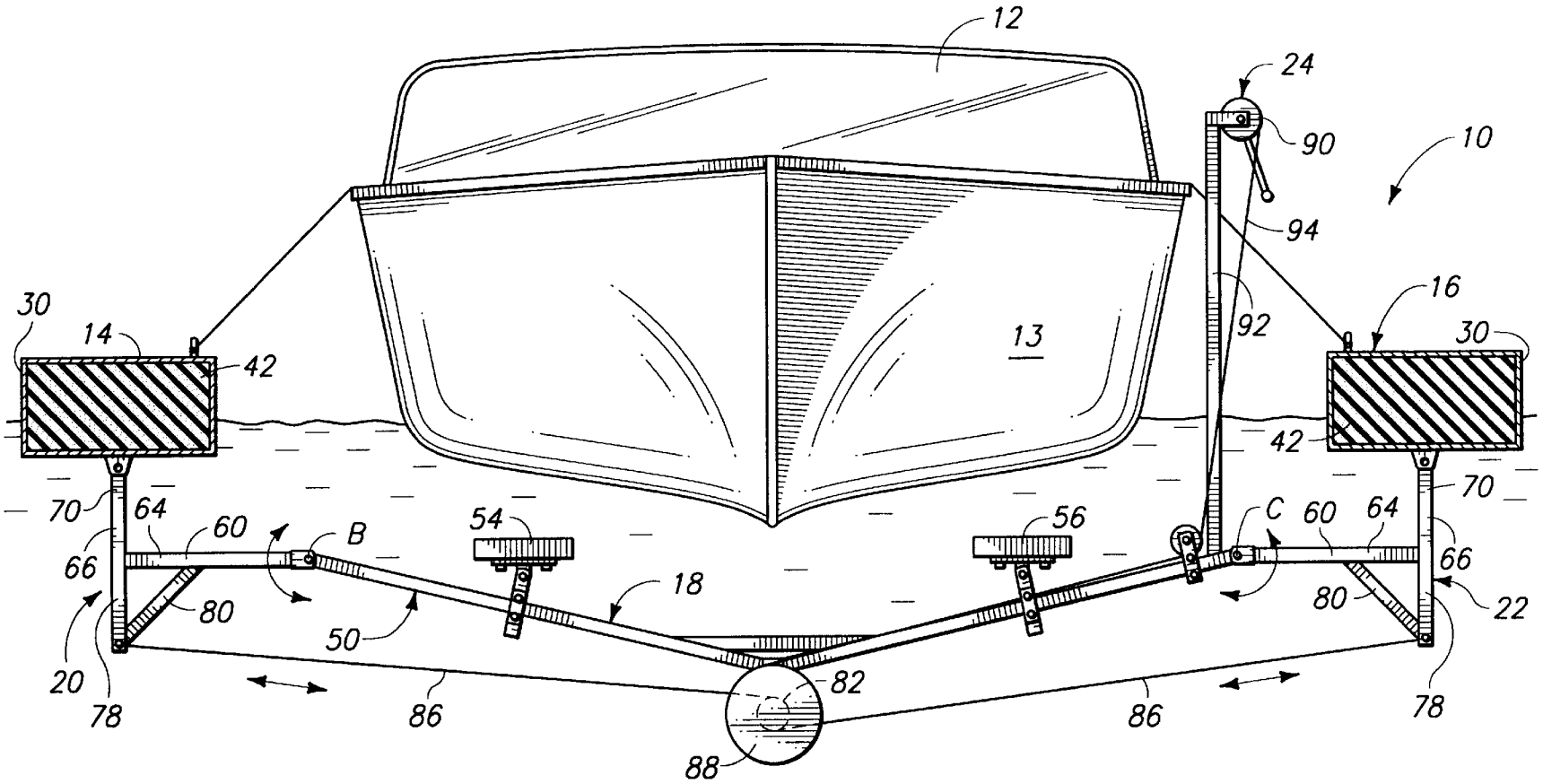
FIG. 2 is a vertical cross-sectional view taken along lines 2—2 in FIG. 1 showing a boat received within the combination boat lift and dock between two pontoons.
Figure 3:
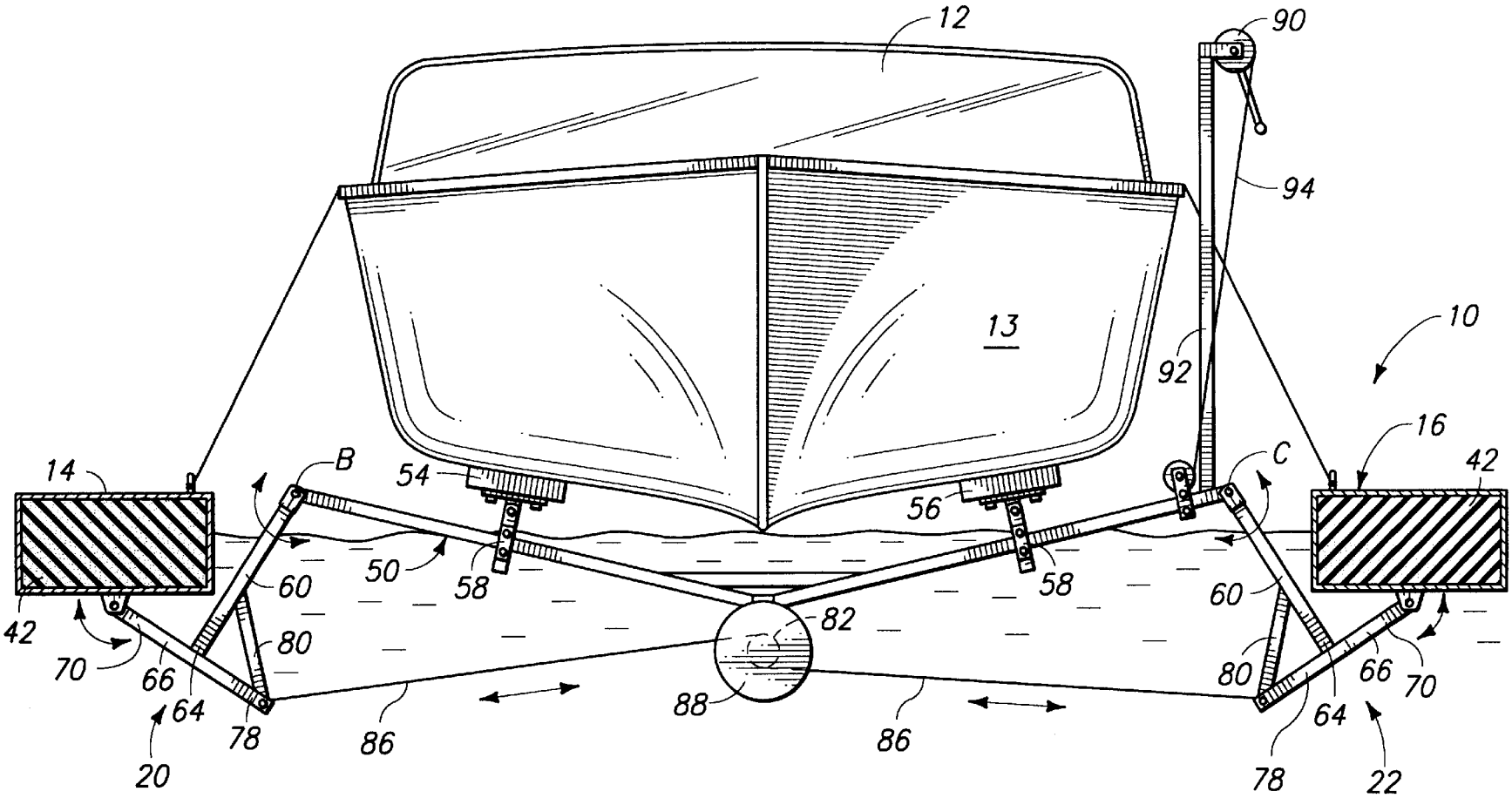
FIG. 3 is a view similar to FIG. 2 except showing the combination boat lift and dock in an elevated position supporting the boat above the water line.

A preferred embodiment of a combination boat lift and dock is illustrated in FIGS. 1, 2 and 3 and is generally designated with the numeral 10. The combination boat lift and dock 10 is designed for receiving and storing water craft 12 having a hull 13. Because of its low cost and ease of use the lift/dock 10 is particularly advantageous for storing rather small motorized craft having hull lengths of less that 36 feet.

The lift/dock 10 has two spaced apart elongated pontoons 14 and 16 that extend substantially parallel to each other on opposite sides of a longitudinal axis "A". A boat support 18 is mounted between the pontoons 14 and 16 substantially aligned with the longitudinal axis "A". Pivot arm structures 20 are pivotally mounted to the boat support 18 and extend laterally outward from the boat support 18 operatively pivotally interconnecting the pontoon 14 to the boat support 18. The pivot structures 20 are designed to pivot relative to the boat support 18 about pivot axis "B". Pivot arm structures 22 are pivotally mounted to the boat support 18 and extend laterally outward from the boat support 18 operatively pivotally interconnecting the pontoon 16 to the boat support 18. The pivot structures 22 are designed to pivot relative to the boat support 18 about pivot axis "C".

The lift/dock 10 has a drive mechanism 24 operatively connected to the arm structures 20 and 22 for pivoting the arm structures 20 and 22 downward and inward toward the longitudinal axis "A" about the pivot axes "B" and "C" moving at least one of the pontoons 14, 16 toward the other. Continued downward and inward pivotal movement of the arm structures 20 and 22 moves the pivot axes "B" and "C" upward thereby lifting the boat support 18 from a lower substantially submerged position illustrated in FIG. 2 to an elevated position illustrated in FIG. 3 to lift the boat 12 out of the water.

The drive mechanism 24 is also operatively connected to the arm structures 20 and 22 to pivot the arm structures 20 and 22 upward and outward to move at least one of the pontoons 14, 16 outward to move the pivot axes "B" and "C" downward thereby lowering the boat support 18 from the elevated position illustrated in FIG. 3 to the lower submerged position illustrated in FIG. 2.

The lift/dock 10 further comprises a pontoon stabilization mechanism 26 extending between the pontoons 14 and 16 for preventing the pontoons 14, 16 from rocking or tilting relative to the longitudinal axis "A" so that a user may readily walk along the pontoons and safely embark and disembark from the boat.

Each of the pontoons 14, 16 includes an elongated enclosed tank body 30 (FIG. 8) of a substantially rectangular cross-section that is filled with a buoyant material 42, such as expanded polymer foam. The tank body 30 has a top wall 32 with an outer non-skid walking surface 34 thereon. The tank body has side walls 36 and 38 and a bottom wall 40. Alternatively, the tank body 30 may be rounded with a flat decking mounted on it with a non-skid walking surface 34. One of the objects of the pontoon stabilizing mechanism 26 is to maintain the non-skid surfaces of the pontoons 14, 16 horizontal to prevent the pontoons 14, 16 from tipping from side-to-side.

The boat support 18 is operatively connected to the pontoons 14, 16 for vertical movement between a lower substantially submerged, unengaged position beneath a boat and an elevated engaged position that supports a boat out of the water. The boat support 18 has a substantially rigid frame 46 with a central longitudinal keel beam 48 extending along the longitudinal axis "A". Two or more cross-beams 50 and 52 are affixed to the keel beam 48 and extend outward to opposite sides of the longitudinal axis "A" toward the pontoons 14, 16 at desired longitudinal locations. Boat support pads 54 and 56 are supported on brackets 58 that are in turn mounted on the cross-beams for engaging the boat hull 13. Preferably the pads 54 and 56 are elongated and extend longitudinally between the cross-beams 50 and 52 to provide additional structural strength to the boat support. For some boats it may be desirable to provide alternative hull engaging supports similar to that provided on boat trailers.

Figure 8B:
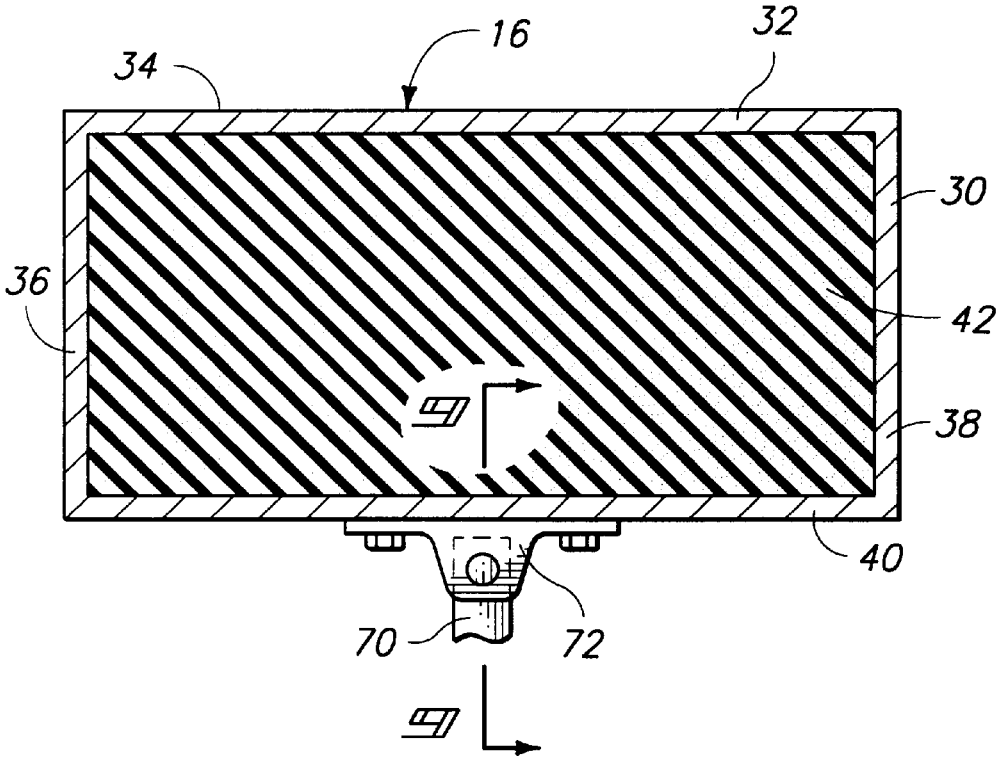
FIG. 8 is a vertical cross-section taken along line 8—8 of FIG. 1 showing a portion of one of the pontoons.
Figure 9:
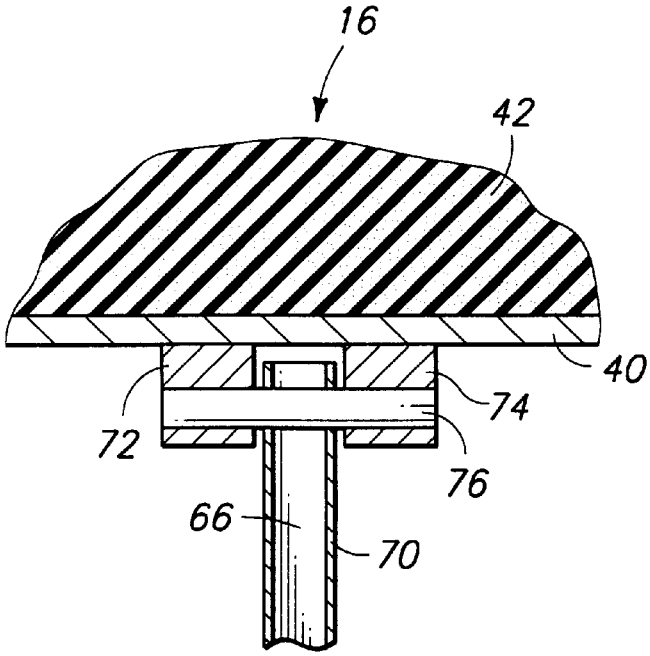
FIG. 9 is a vertical cross-sectional view taken along line 9—9 in FIG. 8.

Each of the pivot arm structures 20, 22 (FIGS. 2 and 3) has an elongated upper arm element 60 with an inner end pivotally connected to one of the cross-beams 50, 52 for pivoting about one of the pivot axes "B", "C". The elongated upper arm element 60 has an outer end 64 connected to a lower arm element 66. The lower arm element 66 has an outer end 70 that is pivotally connected to the bottom wall 40 of one of the pontoons 14, 16. As illustrated in FIGS. 8 and 9 pivot bearings 72, 74 are affixed to the bottom wall 40 and receive a pivot shaft 76 that is aligned substantially parallel with the longitudinal axis "A". The shaft 76 extends through the outer end 70 to enable the arm structure to pivot about the pivot shaft 76. It should be noted that the shaft 76 is located below and in vertical alignment with the center-of-gravity of the pontoon 14, 16 so that minimum rocking forces are applied to the pontoons when the boat support 18 is raised or lowered.

Each of the pivot arm structures 20, 22 have a drive lever element 78 that extends downward from the lower arm element 66 for connecting with the drive mechanism 24. A structural brace element 80 provides structural support for the lever element 78.

Figure 7:
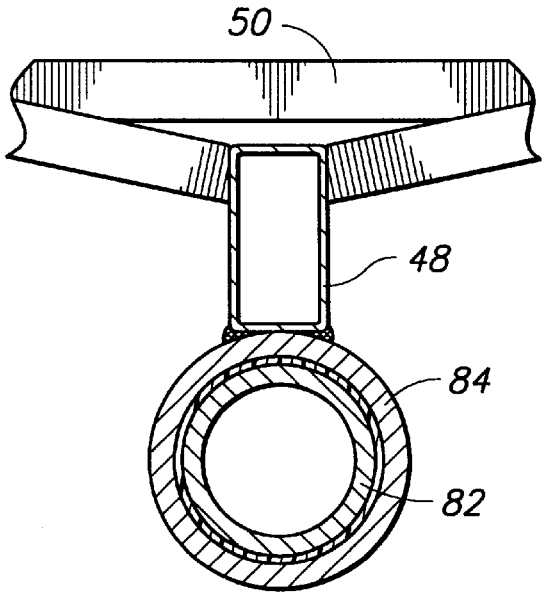
FIG. 7 is a fragmentary cross-sectional view taken along line 7—7 in FIG. 1 showing a drive shaft of the drive mechanism being rotatably supported in a bearing.

The drive mechanism 24 includes an elongated spool or pipe 82 that is rotatably mounted on the boat support 18. Preferably the spool 82 is rotatably mounted in bearings 84 that are mounted at longitudinally spaced locations on the keel beam 48, as shown in FIGS. 1 and 7. Drive cables 86 are mounted or wrapped on the elongated spool with ends extending laterally outward connecting with the drive lever elements 78 as shown in FIGS. 2 and 3.

When the spool 82 is rotated in one direction the cables 86 are wound onto the spool 82 pulling the arms structures 20, 22 downward and inward about their respective pivot axes "B" and "C" to raise the boat support 18. When the spool 82 is rotated in the opposite direction, the cables 86 are payed out causing the pivot arm structures 20, 22 to pivot upward and outward about their respective pivot axes "B" and "C" to lower the boat support 18. A drive pulley 88 is affixed to one end of the spool 82 for rotating the spool 82.

Figure 6:
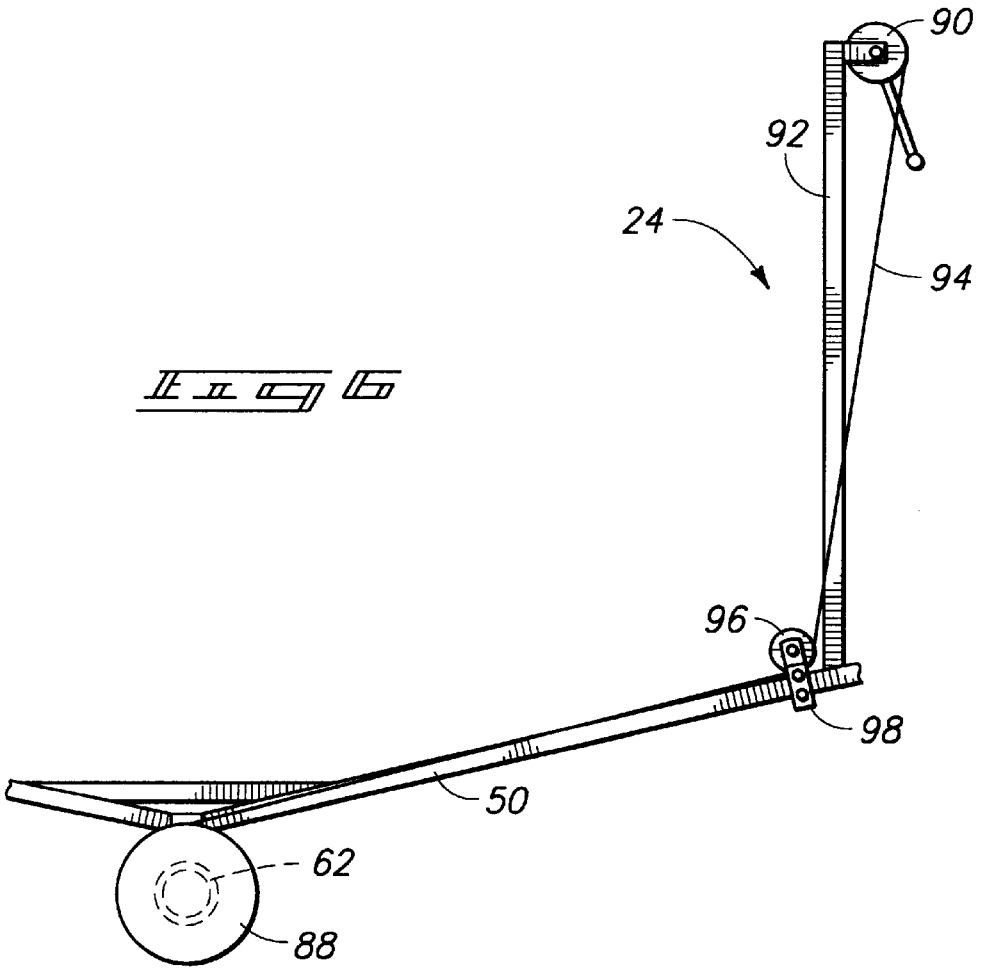
FIG. 6 is a fragmentary vertical cross-sectional view taken along lines 6—6 in FIG. 1 showing a drive mechanism for moving the combination boat lift and dock from the lower position to the elevated position.

The drive mechanism 24 preferably includes a hand or motorized winch 90 (FIG. 6) mounted on an upright 92 supported by the cross-beam 50. The winch 90 has a winch cable 94 extending through an idler wheel 96 to the pulley 88. The idler wheel 96 is supported by an idler wheel bracket 98 mounted on the cross-beam 50. When the winch 90 is wound, the winch cable 94 rotates the pulley 88 in the one direction to pivot the pivot arm structures 20, 22 downward and inward. When the winch 90 is released, the winch cable is payed out allowing the pulley 88 to rotate in the opposite direction to permit the pivot arms structures 20, 22 to pivot upward and outward under the gravitational force of the boat support 18 and boat 12.

Figure 4:
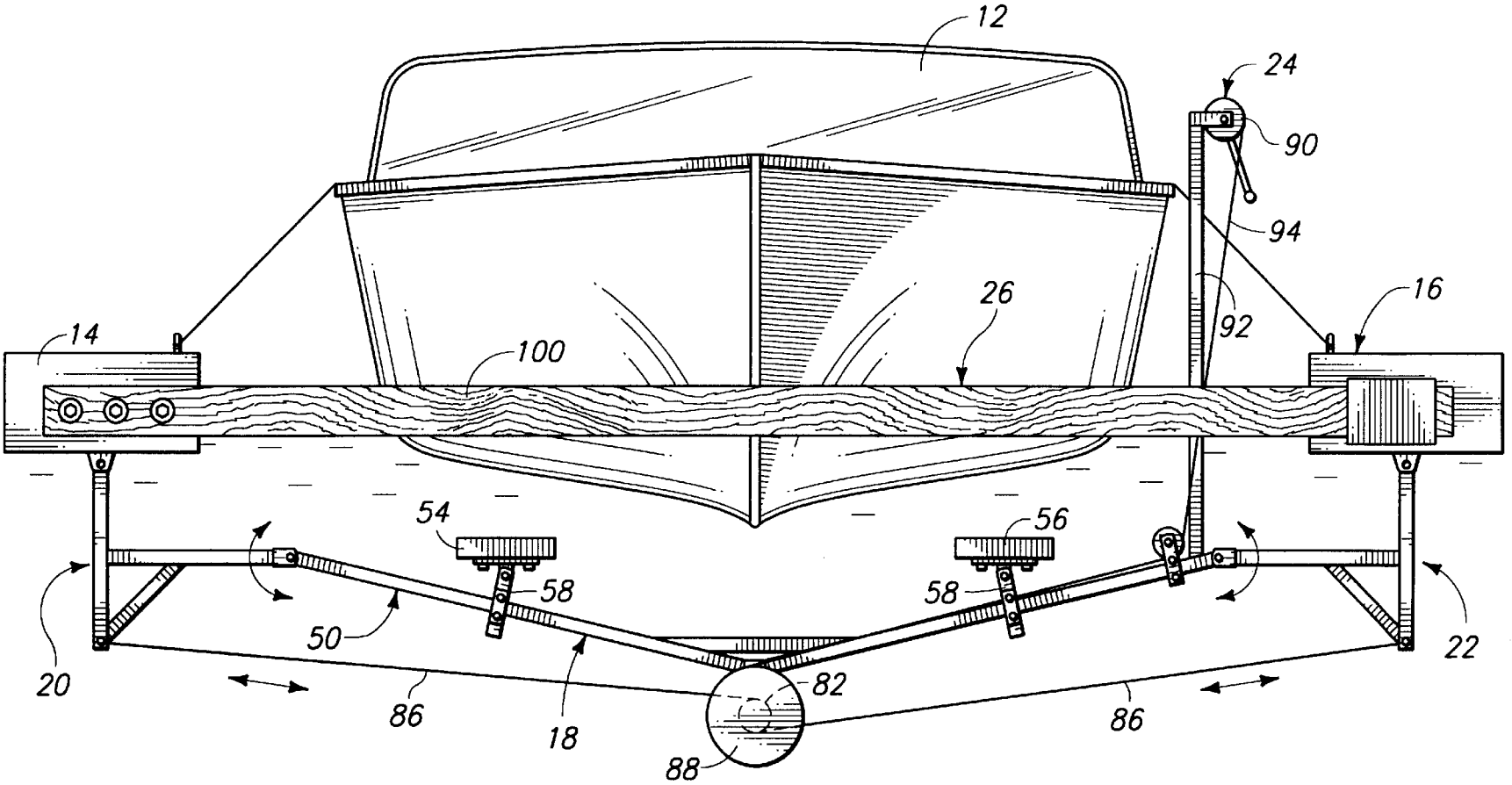
FIG. 4 is a vertical front view of the combination boat lift and dock showing a stabilization mechanism for maintaining the pontoons horizontally stable when the combination boat lift and dock is in a lowered position.
Figure 11:
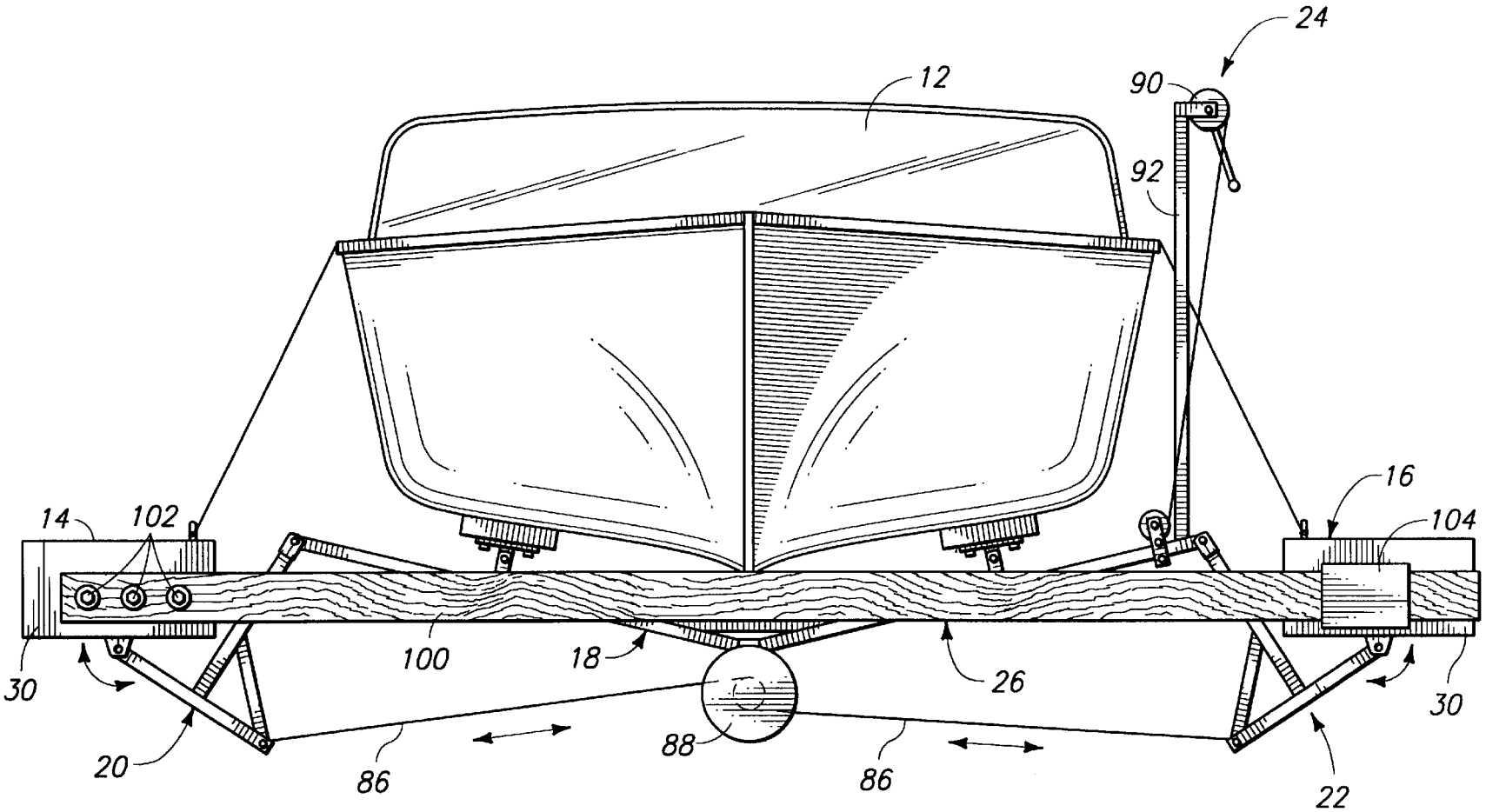

The pontoon stabilizing mechanism 26 (FIGS. 4 and 5) preferably includes a cross-beam 100 that extends between ends of the pontoons 14 and 16 for preventing the pontoons 14 and 16 from rocking and to maintain the walking surfaces 34 horizontal during use. Preferably one end of the cross-beam 100 is rigidly connected to one pontoon 14, 16 by a rigid connector 102 and the other end of the cross-beam 100 is slidably connected to the other pontoon 14, 16 by a sliding connector 104, such as a rectangular tube, which allows the other end of the cross-beam to slidably move back and forth with the lateral movement of the pontoons to prevent the pontoons from rocking or tilting.

It should be appreciated that the lift/dock 10, because of its simplicity, may be manufactured and sold at an affordable price for the small boat owner. The lift/dock 10 may be rather easily transported to the boat owners site in subassembly form and fairly easily finally assembled without the aid of special tools or training. It should be noted that the lift/dock 10 may be easily operated, and in many cases, the lift/dock is sufficiently "user-friendly" to enable the user to raise the boat after each use so that little foreign material builds up on the boat hull.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A combination boat lift and dock comprising:

a boat dock comprising two floating pontoons spaced on opposite sides of a longitudinal dock axis a sufficient distance to receive a boat there between; in which at least one of the pontoons being movable laterally toward and away from the other pontoon;

a central boat support between the pontoons and extending along the longitudinal axis normally beneath the floating boat;

said boat support being movable between a lower substantially submerged position beneath the floating boat and an elevated position supporting the boat above the water surface;

lateral pivot arms extending between the boat support and the pontoons with inner ends of the arms being pivotally connected to the boat support for pivotal movement about pivot axes on opposite sides of the longitudinal axis and with outer ends of the arms being operatively connected to the pontoons; and drive mechanism operatively connected to the pivot arms for (1) pivoting the arms downward and inward about the pivot axes moving at least one of the pontoons inward toward the other pontoon thereby raising the pivot axes and lifting the boat support from the lower position to the elevated position to lift the received boat above the water surface; and (2) permitting the arms to pivot upward and outward causing the one pontoon to move laterally away from the other pontoon to move the boat support from the elevated position to the lower position to lower the received boat into the water.

2. The combination boat lift and dock as defined in claim 1 wherein the outer ends of the arms are operatively pivotally connected to the pontoons below the water surface.

3. The combination boat lift and dock as defined in claim 1 further comprising a pontoon stabilizing mechanism for preventing the moving pontoon from rocking relative to the longitudinal axis when the moving pontoon is moved toward and away from the longitudinal axis.

4. The combination boat lift and dock as defined in claim 3 wherein the pontoon stabilizing mechanism includes a beam extending between the pontoons for preventing the moving pontoon from rocking.

5. The combination boat lift and dock as defined in claim 4 wherein the at least one of the pontoons has a slide connector for receiving one end of the beam to permit the one end to slide relative to the connector while preventing the pontoon from rocking.

6. The combination boat lift and dock as defined in claim 2 wherein the outer ends of the arms are operatively pivotally connected to the pontoons below and in alignment with centers of gravity of the pontoons.

7. The combination boat lift and dock as defined in claim 1 wherein the drive mechanism includes (1) a spool rotatably mounted to the boat support and extending along the longitudinal axis, (2) cables mounted on the spool and extending to the arms, and (3) a winch drive operatively connected to the spool for (a) rotating the spool in one direction to wind the cables about the spool to pivot the arms downward and thereby raise the boat and (b) rotating the spool in the opposite direction to unwind the cables from the spool to permit the arms to pivot upward about the pivot axes to lower the boat into the water.

8. The combination boat lift and dock as defined in claim 1 wherein the boat support includes (1) a substantially rigid frame having (a) a longitudinal beam extending along the longitudinal axis, and (b) boat support cross-beams extending laterally outward from the longitudinal beam toward the pontoons, and (2) boat support pads supported on the boat support cross-beams for engaging a hull of the boat as the boat is being raised.

9. The combination boat lift and dock as defined in claim 8 wherein the drive mechanism includes (1) bearings mounted on the longitudinal beam, (2) an elongated spool rotatably mounted in the bearings, (3) cables mounted on the spool and connected to arms, and (4) a winch drive operatively connected to the spool for rotating the spool in one direction for winding the cables on the spool to pivot the arms downward and inward to raise the boat and for rotating the spool in the opposite direction to pivot the arms upward and outward to lower the boat into the water.

10. The combination boat lift and dock as defined in claim 7 further comprising a pontoon stabilizing mechanism extending between the pontoons for preventing the moving pontoon from rocking relative to the longitudinal axis as the boat is being raised or lowered.

* * * * *